US006731250B1

(12) United States Patent
Berman

(10) Patent No.: US 6,731,250 B1
(45) Date of Patent: May 4, 2004

(54) MOVABLE WINDOW SUPPORT DEVICE FOR A SATELLITE TV DISH

(76) Inventor: Elliot Berman, 2365 Rolling Oaks Dr., Palm Harbor, FL (US) 34683

( * ) Notice: Subject to any disclaimer, the term of this patent is extended or adjusted under 35 U.S.C. 154(b) by 0 days.

(21) Appl. No.: 10/315,371

(22) Filed: Dec. 10, 2002

(51) Int. Cl.[7] ..... H01Q 1/10; H01Q 1/12

(52) U.S. Cl. ..... 343/878; 343/880; 343/883

(58) Field of Search ..... 343/878, 880, 343/882, 892, 890, 883; 455/347, 98

(56) References Cited

U.S. PATENT DOCUMENTS

| | | | | |
|---|---|---|---|---|
| 2,570,333 | A | 10/1951 | Ercolino | |
| 3,158,866 | A | 11/1964 | Powers | |
| 4,181,284 | A | 1/1980 | Seppelfrick | |
| 4,994,816 | A | 2/1991 | Kondo | |
| 5,082,037 | A | 1/1992 | Hammons et al. | |
| 5,641,191 | A | 6/1997 | Jia | |
| 5,647,567 | A | 7/1997 | Pugh, Jr. et al. | |
| 5,884,890 | A | 3/1999 | Fraley, Jr. | |
| 5,961,092 | A | 10/1999 | Coffield | |
| 6,037,913 | A | 3/2000 | Johnson | |
| 6,195,066 | B1 | 2/2001 | Pegues, Jr. et al. | |
| 6,362,791 | B1 * | 3/2002 | Patterson | 343/702 |
| 6,367,750 | B1 | 4/2002 | Ford | |
| 6,371,429 | B1 | 4/2002 | Gillespie | |
| 2003/0122728 | A1 * | 7/2003 | Antoine | 343/878 |

* cited by examiner

*Primary Examiner*—Don Wong
*Assistant Examiner*—Creinh Vo Dinh
(74) *Attorney, Agent, or Firm*—Larson & Larson, PA; James E. Larson

(57) ABSTRACT

A bottom bracket is attached to a vertical wall below a window inside a room. A top bracket joins a longitudinal housing to the bottom bracket. The longitudinal housing encloses multiple telescoping side rails for extending a top support plate outwardly from the housing to a position outside an open window. An upper surface of the top support plate is attached to a satellite TV dish base plate.

14 Claims, 4 Drawing Sheets

MOVABLE WINDOW SUPPORT DEVICE FOR A SATELLITE TV DISH

BACKGROUND OF THE INVENTION

This invention relates to a support device for a satellite TV dish. More particularly, it refers to a device supporting a satellite TV dish having a movable component to permit ingress and egress of a satellite TV dish from an operating condition outside a window to a standby storage condition in a room inside the window.

Antenna brackets for mounting TV antennas to a building are well known as shown in U.S. Pat. Nos. 4,181,284; 4,994,816; 5,647,567; and 6,195,066. These are all permanently mounted to a building structure and cannot be movably retracted inside the building. In many condominiums, apartment complexes and deed restricted communities there are regulations prohibiting the permanent mounting of satellite TV dishes outside a building. Since satellite dishes require line of sight reception, such regulations could prevent satellite dish owners from using satellite TV reception systems. If satellite TV dishes are to be used in deed restricted communities, a means is needed to retract satellite dishes when not in use. An attempt to provide such means is set forth in U.S. Pat. No. 6,037,913. However, the support bracket for the satellite dish is mounted outside a building on a balcony side wall. Even though not an exterior main wall of the building, it is still required on an exterior side wall. Accordingly, a mounting bracket is still visible outside the inner space of the building. Such an arrangement is prohibited by regulations in many deed restricted condominiums and housing communities. A system is sorely needed for mounting a satellite dish inside a room of a building with capability of movably projecting the satellite dish outside a window of the building.

SUMMARY OF THE INVENTION

The above problem has been solved by the apparatus employed in this invention. The satellite dish support device of this invention is mounted on a wall bracket below a window in a room of a building. The wall bracket supports a housing containing a movable platform that mounts the satellite dish distal from the housing when the satellite dish is in use. The platform is moved from the housing outwardly by multiple telescoping slide rails. In this manner, the satellite dish is stored inside a room adjacent a window when not in use. The satellite dish in use is slid outwardly through an open window by extending the slide rails from inside the housing. The satellite dish is adjusted in an angle of reception by the manner of positioning the support base for the satellite dish on the movable platform and by adjusting a pivot point on a satellite stem supporting the satellite dish above its support base.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
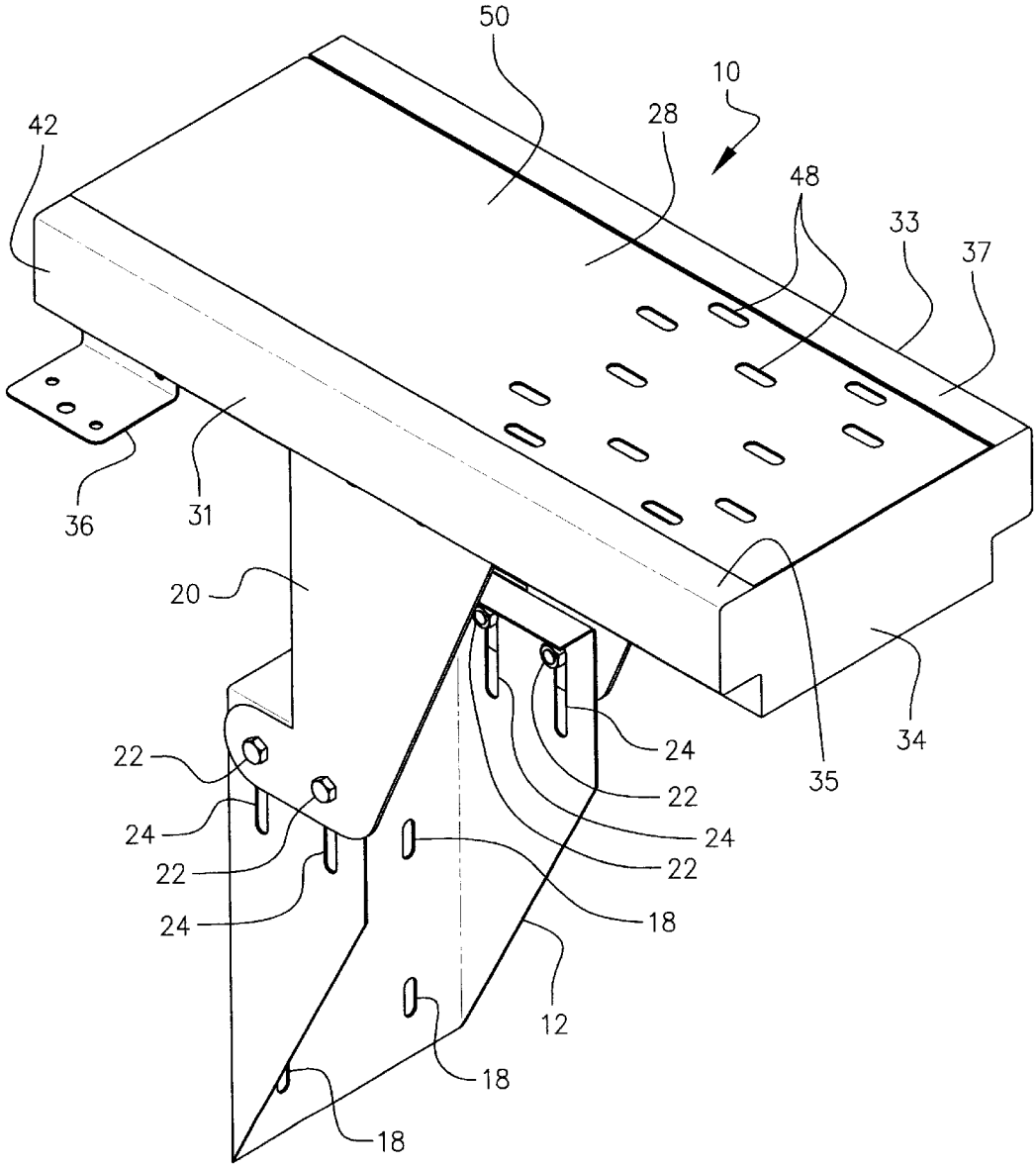
FIG. 1 is a perspective view of the support device in its retracted position.

Throughout the following detailed description, the same reference numerals refer to the same elements in all figures.

Figure 2:
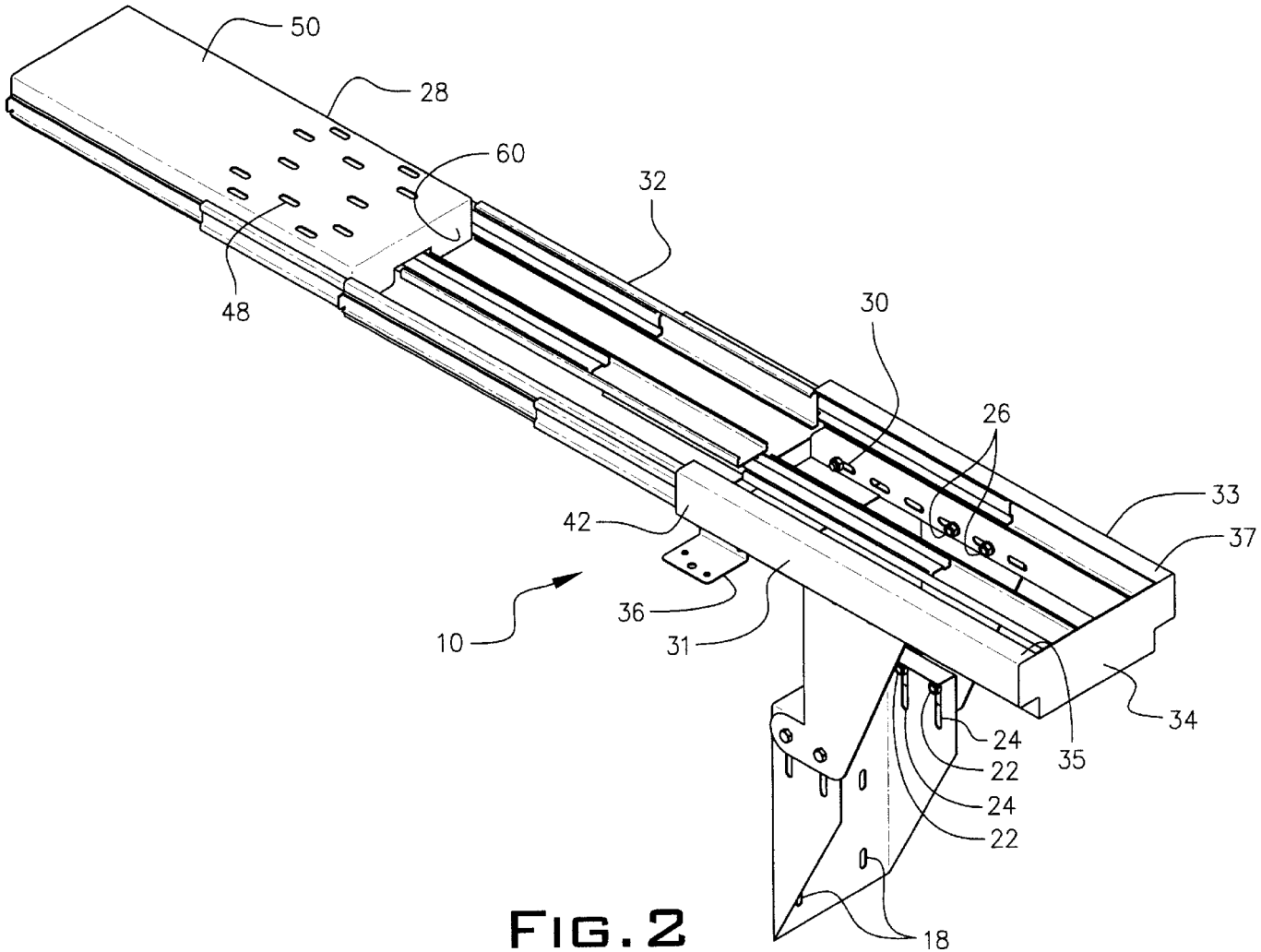
FIG. 2 is a perspective view of the support device in its extended position.

The satellite TV support device 10 of this invention is shown in FIGS. 1 and 2. A U-shaped bottom bracket 12 is screwed into an interior wall 14 of a room with screws 16 through front slots 18 in bottom bracket 12. An adjustable top bracket 20 is bolted to bottom bracket 12 by bolts 22 through side slots 24 in bottom bracket 12. Top bracket 20 is bolted by bolts 26 to sides 31 and 33 of a housing 34 through slots 30. The housing 34 encloses telescoping slide rails 32. Flanges 35 and 37 integral with, but at right angles to sides 31 and 33, respectively, are juxtaposed to a longitudinal support plate 28. The longitudinal support plate 28 moves outwardly as shown in FIG. 2 on the telescoping slide rails 32. Housing 34 encloses the slide rails 32 supporting the longitudinal support plate 28 as seen in FIG. 1 in the retracted position.

Figure 3:
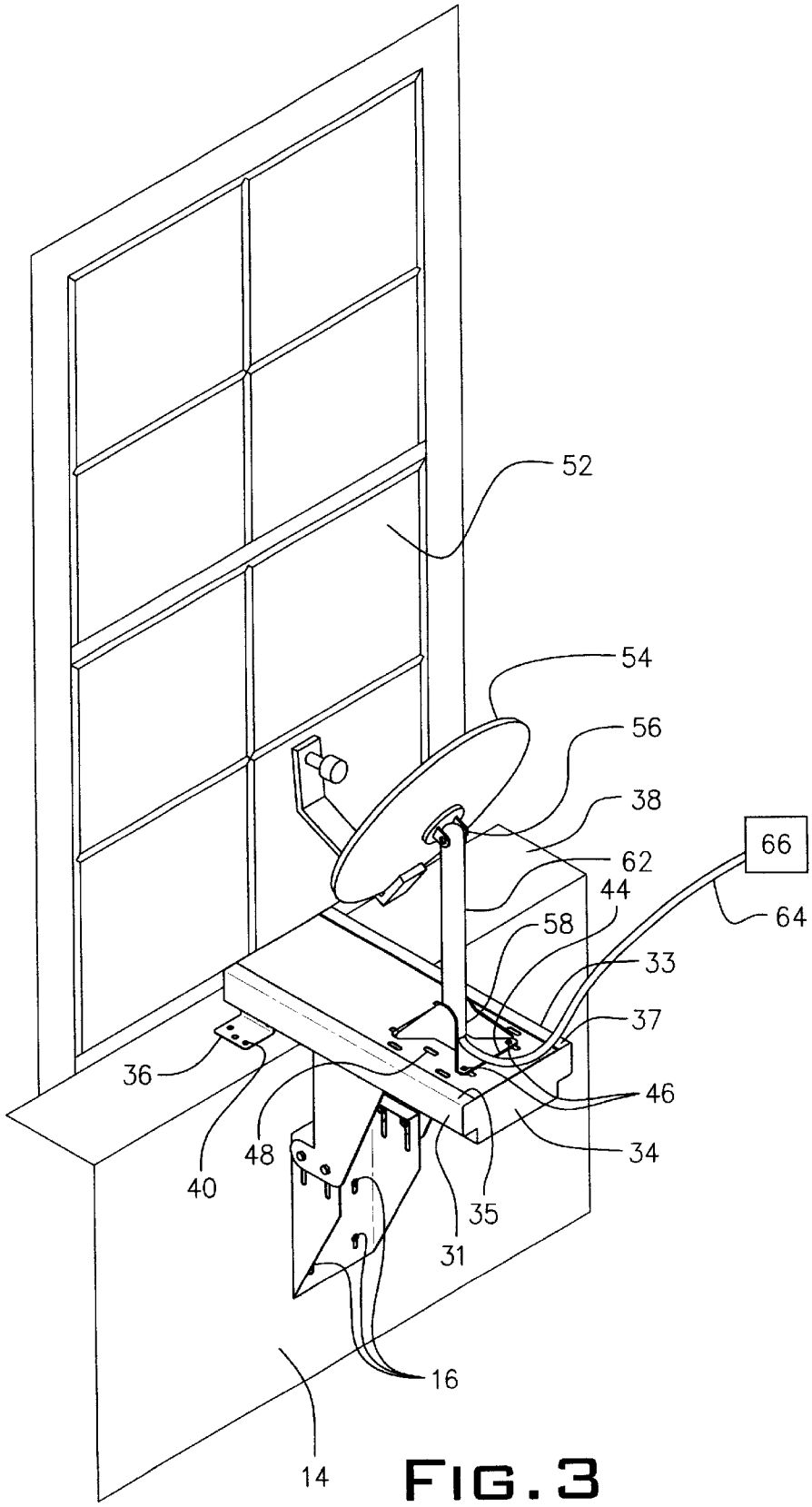
FIG. 3 is a perspective view of the support device and satellite dish mounted inside a window for storage with a bottom bracket attached to an interior wall of a room.
Figure 4:
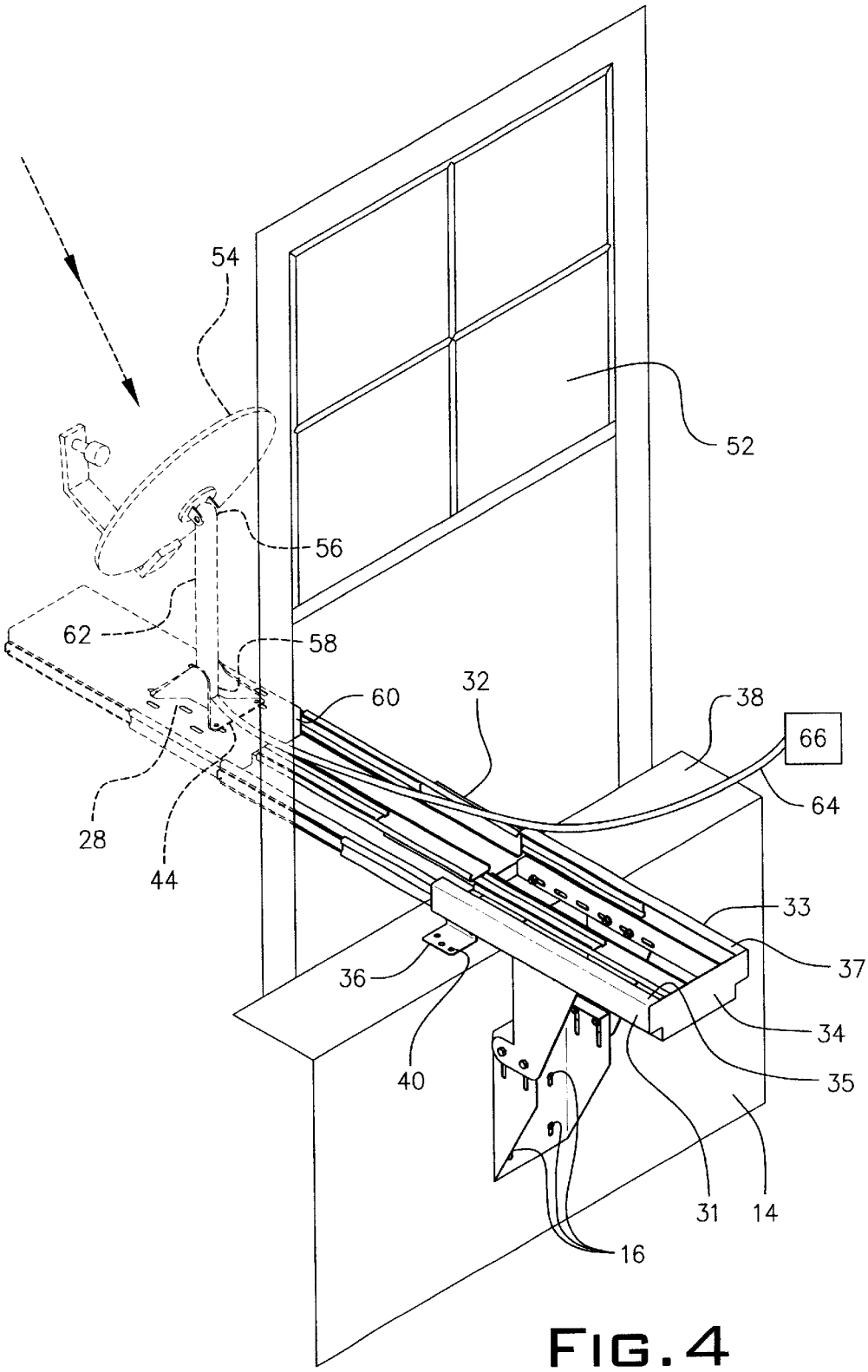
FIG. 4 is a perspective view of the support device of FIG. 3 partially in phantom with a satellite dish slidably moved outside an open window for contact with a satellite signal.

Wing brackets 36 on a forward portion 42 of housing 34 is attached to window sill 38 by screws 40 as seen in FIGS. 3 and 4. A satellite TV dish base plate 44 is mounted by bolts 46 through slots 48 in a top surface 50 of the longitudinal support plate 28. The standby stored position of the support device attached to the satellite dish base plate 44 inside a window 52 is shown in FIG. 3.

When the satellite TV dish 54 is operated to obtain a satellite signal, the window 52 is opened as shown in FIG. 4 and the slide rails 32 are extended to slide longitudinal support plate 28 outside window 52. The dish 54 is adjusted at pivot point 56 to adjust the dish in the proper direction for obtaining a satellite signal. In addition, the dish base plate 44 can be adjusted to improve the dish 54 line of sight to its signal by changing the base plate's position in slots 48 on the support plate 28.

The telescoping slide rails 32 can have interlocking ball bearings as is well known in the prior art to promote a smooth sliding motion for longitudinal support plate 28.

In the satellite signal receiving mode as seen in FIG. 4, the longitudinal support plate 28 supported on slide rails 32 is moved outside the window 52 to a position where the forward portion 42 of housing 34 is about three feet from the rear end 60 of support plate 28. In the extended position as seen in FIG. 4, four telescoping sections to slide rail 32 are employed. More or less telescoping sections can be employed as conditions require. The extension should be sufficiently long to insure that the satellite dish 54 is extended beyond the roof line and eaves of a building.

The housing 34 containing the slide rails 32, about twenty inches long and about nine inches wide, is sufficient to mount and enclose the guide rails 32 and support the satellite TV dish 54. A shaft 62 rising upright from the base plate 44 supports dish 54. The bottom 58 of shaft 62 is attached to base plate 44 and the top portion 56 acts as a pivot point to adjust the line of site of dish 54.

The slide rails, housing, brackets and top support plate are made from steel or other high strength material.

A cable 64 leads from the satellite dish to an indoor TV console 66.

It is understood that a person skilled in the art may make equivalent substitutions for elements employed in the support device without departing from the spirit and scope of the invention. All such equivalents are to be included within the scope of the invention as defined in the appended claims.

Having described the invention, what is claimed for Letters Patent is:

1. A support device for mounting a TV satellite dish inside a room adjacent a window and for slidably extending the satellite dish outside the window when the satellite dish is receiving a signal, the support device comprising:

a bottom bracket attached to a vertical wall below a window inside a room;

a top bracket pivotably attached to a top portion of the bottom bracket at a first end and attached at a second end to a longitudinal housing, the longitudinal housing having opposed side walls, and a back wall, the housing enclosing multiple telescoping slide rails for supporting a movable top support plate and adapted to slidably extend the top support plate outwardly from the housing; and the movable top support plate having attached at a top surface, a base plate for a satellite TV dish.

2. The support device according to claim 1 wherein the bottom bracket is U-shaped with a back portion attached to the vertical wall and a side portion on each side of the back portion attached to a downwardly descending leg from the top bracket.

3. The support device according to claim 1 wherein the longitudinal housing encloses four sections of slidable rails when the satellite dish is inside the room.

4. The support device according to claim 1 wherein the longitudinal housing side walls each have a top flange integral with the side wall but at a right angle to the side wall, the top flanges being juxtaposed to the movable top support plate when the satellite dish is inside the room.

5. The support device according to claim 1 wherein a wing bracket on a forward portion of each housing side wall is integral with the side wall and is attached to a window sill.

6. A device containing a movable support plate supporting a base plate having an upwardly directed shaft pivotably engaged to a TV satellite dish the movable support plate slidably movable from a position inside a room adjacent a window to an extended position outside the window so the satellite dish can receive a TV signal, the device comprising:

a housing attached to multiple telescoping slidable rails, the rails supporting the movable support plate, the housing having a back wall and opposed side walls and an interior portion enclosing the multiple telescoping slidable rails when the support plate is inside the room, the housing attached to a wall of the room below the window by a bracket and to a window sill inside the window by a wing bracket attached to each side wall of the housing.

7. The device according to claim 6 wherein the bracket consists of a first metal element having a back portion attached to the wall of the room and opposed side portions attached to descending legs of a second metal element and each leg of the second metal element attached at a top portion to a corresponding side wall of the housing.

8. The device according to claim 7 wherein the descending legs of the second metal element are attached by multiple bolts to an upper portion of the first metal element opposed side portions.

9. The device according to claim 6 wherein there are four slidable rail sections within the housing.

10. The device according to claim 6 wherein the housing has parallel flanges integral with a top edge of each side wall, the parallel flanges juxtaposed to the movable top supporting plate positioned between the parallel flanges when the movable top support plate is inside the room.

11. A method of storing a TV satellite dish inside a room and extending the TV satellite dish outside a window in the room so that a satellite signal is received by the dish, the method comprising:

attaching a bottom bracket to a vertical wall below a window inside a room;

attaching a bottom portion of a top bracket to a top portion of the bottom bracket and attaching a top portion of the top bracket to a longitudinal housing;

providing the longitudinal housing with a back wall and parallel side walls;

attaching multiple telescoping slide rails to an interior portion of the longitudinal housing;

attaching a movable top support plate to a top portion of a pair of oppositely positioned slide rails;

attaching a satellite dish apparatus to a top surface of the movable top support plate;

opening the window and slidably extending the movable top support plate through the window so that the satellite dish apparatus can receive a satellite signal; and retracting the top support plate to cover the housing interior portion when the satellite signal is no longer desired.

12. The method according to claim 11 wherein when slidably extending the top support plate outwardly from the housing, four sections of side rails are moved outwardly from the housing.

13. The method according to claim 11 wherein the satellite dish apparatus is bolted to slots in a top surface of the top support plate.

14. The method according to claim 13 wherein the satellite dish apparatus is provided with a means to change the direction of aim of the dish to obtain a satellite signal.

* * * * *